US006477999B1

(12) United States Patent
Markley

(10) Patent No.: US 6,477,999 B1
(45) Date of Patent: Nov. 12, 2002

(54) VANE-TYPE HYDRAULIC VARIABLE CAMSHAFT TIMING SYSTEM WITH LOCKOUT FEATURE

(75) Inventor: George L. Markley, Montour Falls, NY (US)

(73) Assignee: BorgWarner Inc., Auburn Hills, MI (US)

( * ) Notice: Subject to any disclaimer, the term of this patent is extended or adjusted under 35 U.S.C. 154(b) by 0 days.

(21) Appl. No.: 09/503,769

(22) Filed: Feb. 14, 2000

Related U.S. Application Data

(60) Provisional application No. 60/173,330, filed on Dec. 28, 1999.

(51) Int. Cl.[7] ..... F01L 1/344
(52) U.S. Cl. ..... 123/90.17
(58) Field of Search ..... 123/90.15, 90.16, 123/90.17, 90.18, 90.31

(56) References Cited

U.S. PATENT DOCUMENTS

| | | | | |
|---|---|---|---|---|
| 4,858,572 A | | 8/1989 | Shirai et al. | 123/90.12 |
| 5,002,023 A | | 3/1991 | Butterfield et al. | 123/90.15 |
| 5,046,460 A | | 9/1991 | Butterfield et al. | 123/90.15 |
| 5,107,804 A | | 4/1992 | Becker et al. | 123/90.17 |
| 5,507,254 A | | 4/1996 | Melchoir | 123/90.17 |
| 5,797,361 A | | 8/1998 | Mikame et al. | 123/90.17 |
| 5,816,204 A | | 10/1998 | Moriya et al. | 123/90.17 |
| 5,836,275 A | * | 11/1998 | Sato | 123/90.17 |
| 5,870,983 A | * | 2/1999 | Sato et al. | 123/90.17 |
| 5,924,395 A | | 7/1999 | Moriya et al. | 123/90.17 |
| 5,943,989 A | * | 8/1999 | Kira | 123/90.17 |
| 5,979,380 A | | 11/1999 | Nakadouzono et al. | 123/90.17 |
| 6,035,819 A | | 3/2000 | Nakayoshi et al. | 123/90.17 |
| 6,053,138 A | | 4/2000 | Trzmiel et al. | 123/90.17 |
| 6,053,139 A | | 4/2000 | Eguchi et al. | 123/90.17 |
| 6,085,708 A | | 7/2000 | Trzmiel et al. | 123/90.17 |
| 6,105,543 A | | 8/2000 | Ogawa | 123/90.17 |
| 6,129,063 A | | 10/2000 | Niethammer et al. | 123/90.17 |

FOREIGN PATENT DOCUMENTS

| | | |
|---|---|---|
| DE | 198 60 025 A 1 | 7/1999 |
| EP | 0 924 391 A3 | 6/1999 |
| JP | 9-317411 | 12/1997 |

* cited by examiner

*Primary Examiner*—Wellun Lo
(74) *Attorney, Agent, or Firm*—Greg Dziegielewski; Thomas A. Meehan; Emch, Schaffer, Schaub & Porcello Co., L.P.A.

(57) ABSTRACT

A camshaft (126) has a vane (160) secured to an end thereof for non-oscillating rotation therewith. The camshaft also carries a sprocket (132) that can rotate with the camshaft but is oscillatable with respect to the camshaft. The vane has opposed lobes (160*a*, 160*b*) that are received in opposed recesses (132*a*, 132*b*), respectively, of the sprocket. The recesses have greater circumferential extent than the lobes to permit the vane and sprocket to oscillate with respect to one another. The camshaft phase tends to change in reaction to pulses that it experiences during its normal operation, and it is permitted to change only in a given direction, either to advance or retard, by selectively blocking or permitting the flow of pressurized hydraulic fluid, preferably engine oil, from the recesses by controlling the position of a spool within a valve body (192) of a control valve. The sprocket has a passage (252) extending therethrough the passage extending parallel to and being spaced from a longitudinal axis of rotation of the camshaft. A pin (250) is slidable within the passage and is resiliently urged by a spring (254) to a position where a free end of the pin projects beyond the passage. The vane carries a plate (168) with a pocket (168*f*), which is aligned with the passage in a predetermined sprocket to camshaft orientation. The pocket receives hydraulic fluid, and when the fluid pressure is at its normal operating level, there will be sufficient pressure within the pocket to keep the free end of the pin from entering the pocket. At low levels of hydraulic pressure, however, the free end of the pin will enter the pocket and latch the camshaft and the sprocket together in a predetermined orientation.

8 Claims, 9 Drawing Sheets

VANE-TYPE HYDRAULIC VARIABLE CAMSHAFT TIMING SYSTEM WITH LOCKOUT FEATURE

CROSS REFERENCE TO RELATED APPLICATIONS

The subject matter of this application is related to the subject matter of commonly assigned, now abandoned provisional application Serial No. 60/173,330, and to the subject matter of commonly assigned application Ser. No. 60/173,330, which was filed on Dec. 28, 1999.

FIELD OF THE INVENTION

This invention relates to a variable camshaft timing (VCT) system for an automotive engine in which the circumferential position of an engine camshaft is varied relative to the crankshaft, or to another camshaft of the engine, by controllably transferring hydraulic fluid between opposed operators that cooperatively act to reposition the camshaft. More particularly, this invention relates to a VCT system of the foregoing character in which the opposed hydraulic operators are in the form of a diametrically opposed spaced apart pair of lobes of a vane that is secured to the camshaft whose position is to be varied.

BACKGROUND OF THE INVENTION

U.S. Pat. No. 5,002,023 (Butterfield and Smith) and U.S. Pat. No. 5,046,460 (Butterfield, Smith and Dembosky) describe various forms of VCT systems that utilize opposed hydraulic actuators in the form of opposed cylinders to circumferentially reposition an automotive engine camshaft relative to a crankshaft, or relative to another camshaft of the same engine, by controllably transferring pressurized engine lubricating oil from one of the hydraulic cylinders to the other. Further, as is disclosed in U.S. Pat. No. 5,107,804 (Becker, Butterfield, Dembosky, and Smith), the disclosure of which is incorporated by reference herein, a VCT system using the principles of the aforesaid U.S. patents can be simplified in its mechanical and hydraulic aspects by using a vane with a diametrically spaced apart pair of lobes secured to the camshaft in combination with a surrounding housing that is oscillatable with respect to the camshaft, in place of the opposed hydraulic cylinders of the aforesaid patents. An arrangement in which the phase angle of an engine camshaft relative to that of the crankshaft is adjusted by hydraulic action against a series of vanes that are secured to the camshaft and are free to oscillate within chambers of a drive member that is driven in rotation by the crankshaft is also disclosed in U.S. Pat. No. 4,858,572 (Shirai et al.).

A vane-type hydraulically operated VCT system of the type described in the aforesaid U.S. Pat. No. 5,107,804 relies on the presence of pressurized engine lubricating oil or other hydraulic fluid within the VCT system to function properly and predictably. This condition is achieved during normal engine operation, when engine lubricating oil is used as the hydraulic fluid within the VCT system, since adequate pressurization of the engine lubricating oil inherently results from the operation of the engine. However, when an automotive engine is shut off, the pressure of the engine lubricating oil soon drops, and the oil within a VCT system of the aforesaid type will normally drain back to the engine crankcase. Thus, upon the restarting of such an engine, the supply of engine lubricating oil within the VCT system is likely to be inadequate in volume or pressure to ensure its proper operation. During these conditions it is desirable to be able to automatically lock or latch the position of the phase adjusted camshaft relative to that of the crankshaft in a predetermined position, preferably in a centered position between its fully advanced position and its fully retarded position, and to maintain the phase adjusted camshaft in such a locked or latched condition unless the pressure of the engine lubricating oil within the VCT system is adequately high to ensure normal, proper operation of the VCT system.

SUMMARY OF THE INVENTION

According to the present invention there is provided an hydraulically-operated, vane-type variable camshaft timing (VCT) system for an automotive engine in which the vane that is secured to the camshaft is positively locked or latched in its position with respect to a crankshaft driven, rotatable housing during periods of low hydraulic system pressure, for example, during and shortly after engine starting in the case of a VCT system that uses pressurized engine lubricating oil as the hydraulic medium. The housing carries a pin therein that is slidable to and fro along an axis that is spaced from and extends parallel to the axis of rotation of the phase adjusted camshaft. Further, the camshaft has a plate that is secured thereto and that is rotatable therewith, and the plate has a recess therein that is adapted to receive a free, rounded end of the pin of the housing when the pin is circumferentially aligned with the recess and when the pin is at the outer limit of its range of travel. The pin is resiliently biased to the outer limit of its travel by a spring that acts on an opposed end of the pin, and is further biased away from the outer end of its range of travel, and thereby out of engagement with the recess, by pressurized hydraulic fluid within the recess that acts on the free end of the pin during the operation of the engine. The relationship between the hydraulic force that acts on the free end of the pin and the mechanical, spring force that acts on its opposed end is such that the hydraulic force is substantially greater during all normal operating conditions of the engine and the mechanical force is greater only temporarily upon restarting of the engine. Thus, in a VCT system according to the present invention the camshaft is mechanically locked or latched in a predetermined phase relative to the crankshaft, preferably in a centered phase between its fully advanced position and its fully retarded position, to ensure proper starting of the engine at a time when the VCT system could otherwise function unpredictably and unreliably because of inadequate hydraulic pressure within the system. Further, the VCT system according to the present invention prevents impacts between the VCT system components during and shortly after starting, when the system can be fully or partly filled with air and when such impacts could occur because of the compressibility of air and the sensitivity of a VCT system of the type described in the aforesaid U.S. Pat. No. 5,107,804 to torque fluctuations during each rotation of the camshaft. Thus, the latching or locking feature of the VCT system of the present invention prevents such impacts, and the damage and noise resulting therefrom, by ensuring that no phase adjustment can occur until the VCT system is filled with pressurized fluid and the associated check valves can function properly to prevent hydraulic fluid transfer within the system except when desired to effect a change in camshaft phase angle.

Accordingly, it is an object of the present invention to provide an improved vane-type hydraulic variable camshaft timing (VCT) system. More particularly, it is an object of the present invention to provide a VCT system of the foregoing character with a mechanical locking feature that will function to prevent changes in camshaft phase angle whenever the pressure of the hydraulic fluid within the VCT system is inadequate to ensure its proper operation. Specifically it is an object of the present invention to provide a VCT system of the foregoing character that utilizes pressurized engine lubricating oil as the hydraulic medium, and incorporates a locking or latching feature to prevent changes in camshaft phase angle during and shortly after the restarting of the engine, when the pressure of the engine lubricating oil within the variable camshaft timing system is inadequate to ensure its proper operation.

For a further understanding of the present invention and the objects thereof, attention is directed to the drawing and the following brief description thereof, to the detailed description of the preferred embodiment and to the appended claims.

DETAILED DESCRIPTION OF THE PREFERRED EMBODIMENT

Figure 1:
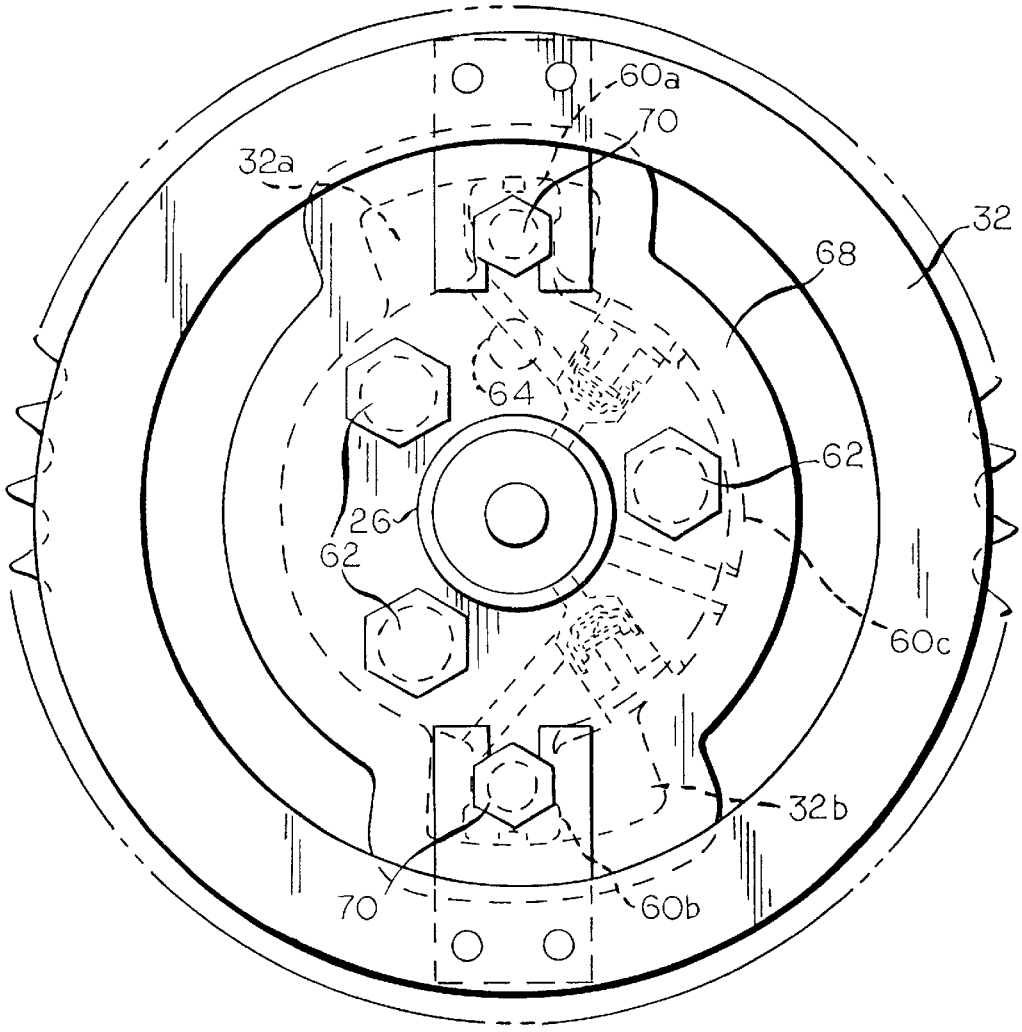
FIG. 1 (PRIOR ART)
FIG. 1 is an end elevational view of a camshaft with elements of an embodiment of a variable camshaft timing system applied thereto.
Figure 2:
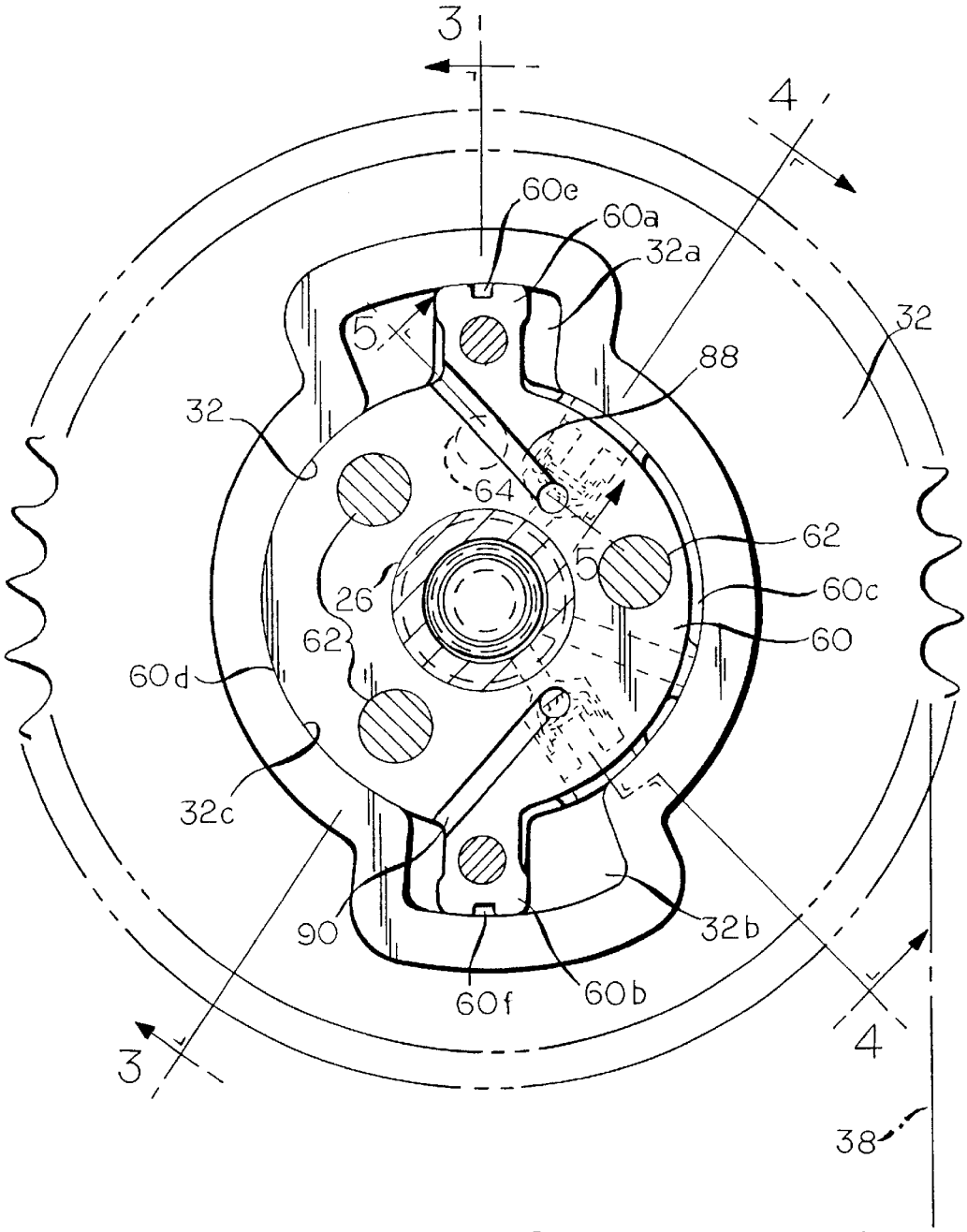
FIG. 2 (PRIOR ART)
FIG. 2 is a view similar to FIG. 1 with a portion of the structure thereof removed to more clearly illustrate other portions thereof.

FIGS. 1–10 illustrate a vane-type, hydraulic variable camshaft timing (VCT) system according to an embodiment of the aforesaid U.S. Pat. No. 5,107,804 in which a housing in the form of a sprocket 32 is oscillatingly journalled on a camshaft 26.

The camshaft 26 may be considered to be the only camshaft of a single camshaft engine, either of the overhead camshaft type or the in block camshaft type. Alternatively, the camshaft 26 may be considered to be either the intake valve operating camshaft or the exhaust valve operating camshaft of a dual camshaft engine. In any case, the sprocket 32 and the camshaft 26 are rotatable together, and are caused to rotate by the application of torque to the sprocket 32 by an endless roller chain 38, shown fragmentarily, which is trained around the sprocket 32 and also around a crankshaft, not shown. As will be hereinafter described in greater detail, the sprocket 32 is oscillatingly journalled on the camshaft 26 so that it is oscillatable at least through a limited arc with respect to the camshaft 26 during the rotation of the camshaft, an action that will adjust the phase of the camshaft 26 relative to the crankshaft.

An annular pumping vane 60 is fixedly positioned on the camshaft 26, the vane 60 having a diametrically opposed pair of radially outwardly projecting lobes 60*a*, 60*b* and being attached to an enlarged end portion 26*a* of the camshaft 26 by bolts 62 that pass through the vane 60 into the end portion 26*a*. In that regard, the camshaft 26 is also provided with a thrust shoulder 26*b* (FIG. 3 ) to permit the camshaft to be accurately positioned relative to an associated engine block, not shown. The pumping vane 60 is also precisely positioned relative to the end portion 26*a* by a dowel pin 64 that extends therebetween. The lobes 60*a*, 60*b* are received in radially outwardly projecting recesses 32*a*, 32*b*, respectively, of the sprocket 32, the circumferential extent of each of the recesses 32*a*, 32*b* being somewhat greater than the circumferential extent of the vane lobe 60*a*, 60*b* that is received in such recess to permit limited oscillating movement of the sprocket 32 relative to the vane 60. The recesses 32*a*, 32*b* are closed around the lobes 60*a*, 60*b*, respectively, by spaced apart, transversely extending annular plates 66, 68 (FIG. 21) that are fixed relative to the vane 60, and, thus, relative to the camshaft 26, by bolts 70, which extend from one to the other through the same lobe, 60*a* or 60*b*. Further, the inside diameter 32*c* of the sprocket 32 is sealed with respect to the outside diameter of the portion 60*d* of the vane 60, that is between the lobes 60*a*, 60*b*, and the tips of the lobes 60*a*, 60*b* of the vane 60 are provided with seal receiving slots 60*e*, 60*f*, respectively. Thus each of the recesses 32*a*, 32*b* of the sprocket 32 is capable of sustaining hydraulic pressure, and within each recess 32*a*, 32*b* the portion on each side of the lobe 60*a*, 60*b*, respectively, is capable of sustaining hydraulic pressure.

Figure 10:
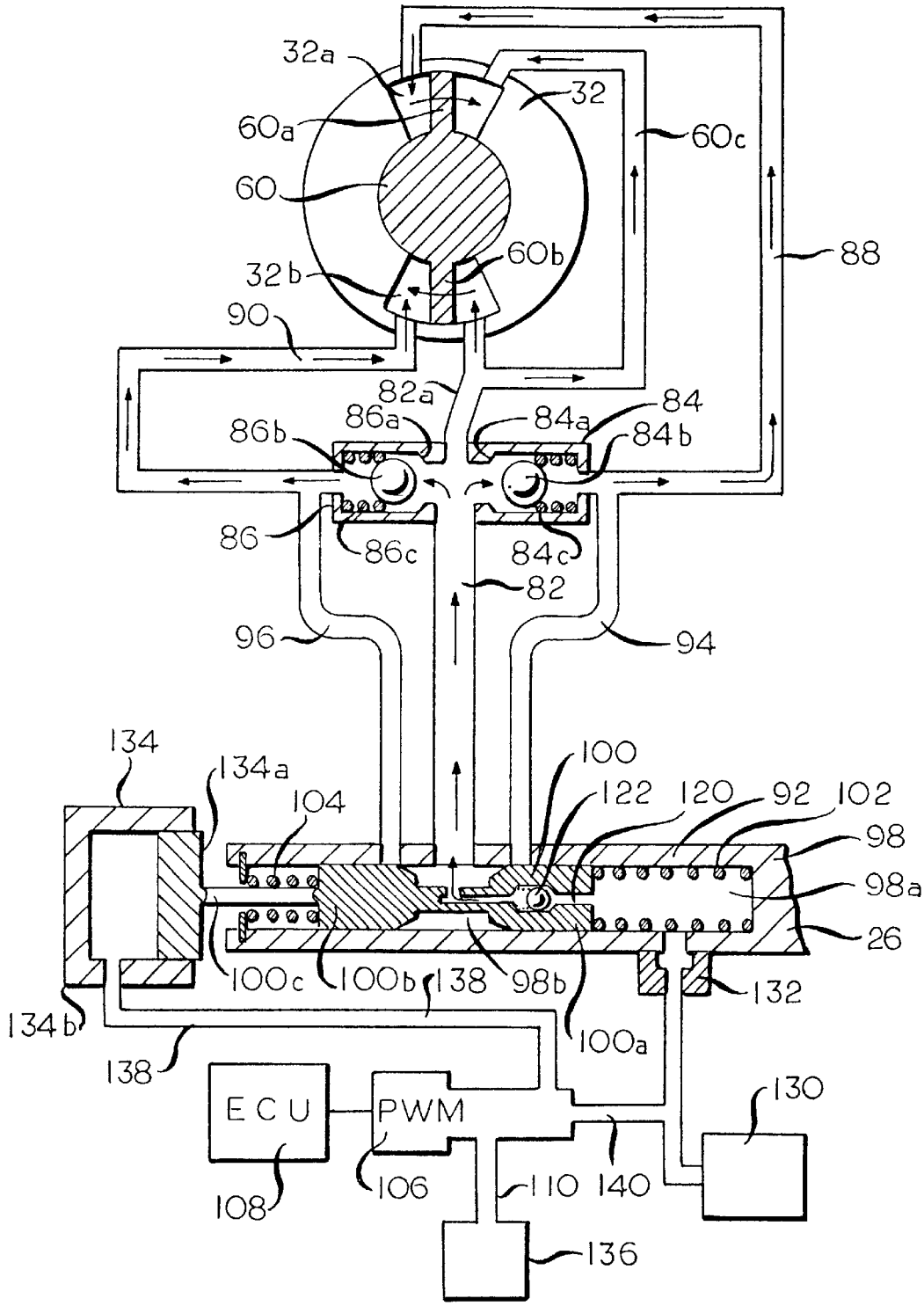
FIG. 10 (PRIOR ART)
FIG. 10 is a simplified schematic view of the variable camshaft timing arrangement of FIGS. 1–9.

The functioning of the structure of the embodiment of FIGS. 1–9, as thus far described, may be understood by reference to FIG. 10. Hydraulic fluid, illustratively in the form of engine lubricating oil, flows into the recesses 32*a*, 32*b* by way of a common inlet line 82. The inlet line 82 terminates at a juncture between opposed check valves 84 and 86 that are connected to the recesses 32*a*, 32*b*, respectively, by branch lines 88, 90, respectively. The check valves 84, 86 have annular seats 84*a*, 86*a*, respectively, to permit the flow of hydraulic fluid through the check valves 84, 86 into the recesses 32*a*, 32*b*, respectively. The reverse flow of hydraulic fluid through the check valves 84, 86, is blocked by floating balls 84*b*, 86*b*, respectively, which are urged against the seats 84*a*, 86*a* by springs 84*c*, 86*c*, respectively. The check valves 84, 86, thus, permit the initial filling of the recesses 32*a*, 32*b* and provide for a continuous supply of make-up hydraulic fluid to compensate for leakage therefrom. Hydraulic fluid enters the line 82 by way of a spool valve 92, which is incorporated within the camshaft 26, and hydraulic fluid is returned to the spool valve 92 from the recesses 32*a*, 32*b* by return lines 94, 96, respectively.

The spool valve 92 is made up of a cylindrical member 98 and a spool 100 is slidable to and fro within the member 98. The spool 100 has cylindrical lands 100*a* and 100*b* on opposed ends thereof, and the lands 100*a* and 100*b*, which fit snugly within the member 98, are positioned so that the land 100*b* will block the exit of hydraulic fluid from the return line 96, or the land 100*a* will block the exit of hydraulic fluid from the return line 94, or the lands 100*a* and 100*b* will block the exit of hydraulic fluid from both the return lines 94 and 96, as is shown in FIG. 10, where the camshaft 26 is being maintained in a selected position relative to the crankshaft of the associated engine.

The position of the spool 100 within the member 98 is influenced by an opposed pair of springs 102, 104, which act on the ends of the lands 100*a*, 100*b*, respectively. Thus, the spring 102 resiliently urges the spool 100 to the left, in the orientation illustrated in FIG. 10, and the spring 104 resiliently urges the spool 100 to the right in such orientation. The position of the spool 100 within the member 98 is further influenced by a supply of pressurized hydraulic fluid within a portion 98a of the member 98, on the outside of the land 100*a*, which urges the spool 100 to the left. The portion 98*a* of the member 98 receives its pressurized fluid (engine oil) directly from the main oil gallery ("MOG") 130 of the engine, and this oil is also used to lubricate a bearing 132 in which the camshaft 26 of the engine rotates.

The control of the position of the spool 100 within the member 98 is in response to hydraulic pressure within a control pressure cylinder 134 whose piston 134*a* bears against an extension 100*c* of the spool 100. The surface area of the piston 134*a* is greater than the surface area of the end of the spool 100 that is exposed to hydraulic pressure within the portion 98, and is preferably twice as great. Thus, the hydraulic pressures that act in opposite directions on the spool 100 will be in balance when the pressure within the cylinder 134 is one-half that of the pressure within the portion 98*a*. This facilitates the control of the position of the spool 100 in that, if the springs 102 and 104 are balanced, the spool 100 will remain in its null or centered position, as illustrated in FIG. 10, with less than full engine oil pressure in the cylinder 134, thus allowing the spool 100 to be moved in either direction by increasing or decreasing the pressure in the cylinder 134, as the case may be.

Figure 3:
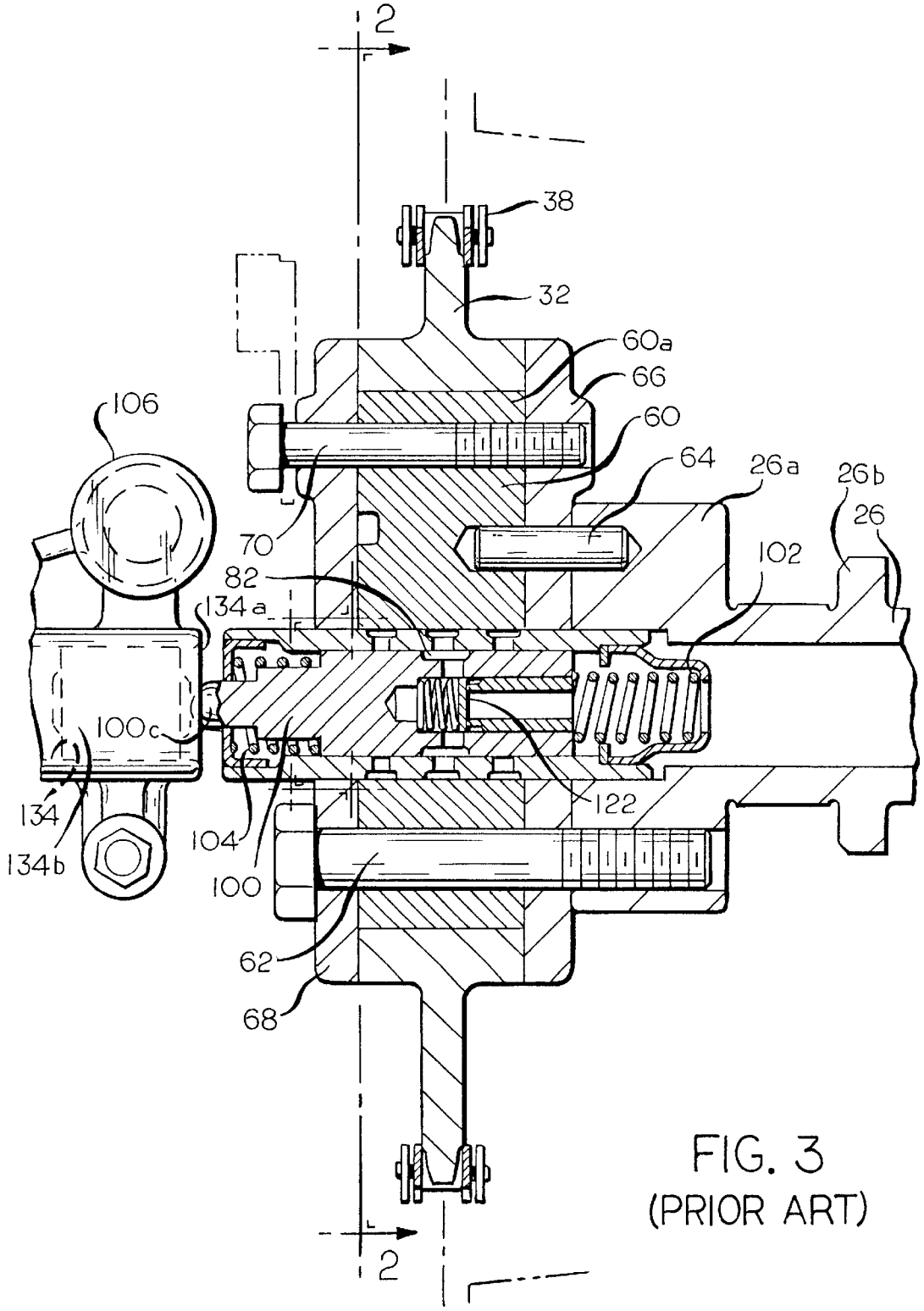
FIG. 3 (PRIOR ART)
FIG. 3 is a sectional view taken on line 3—3 of FIG. 2.
Figure 4:
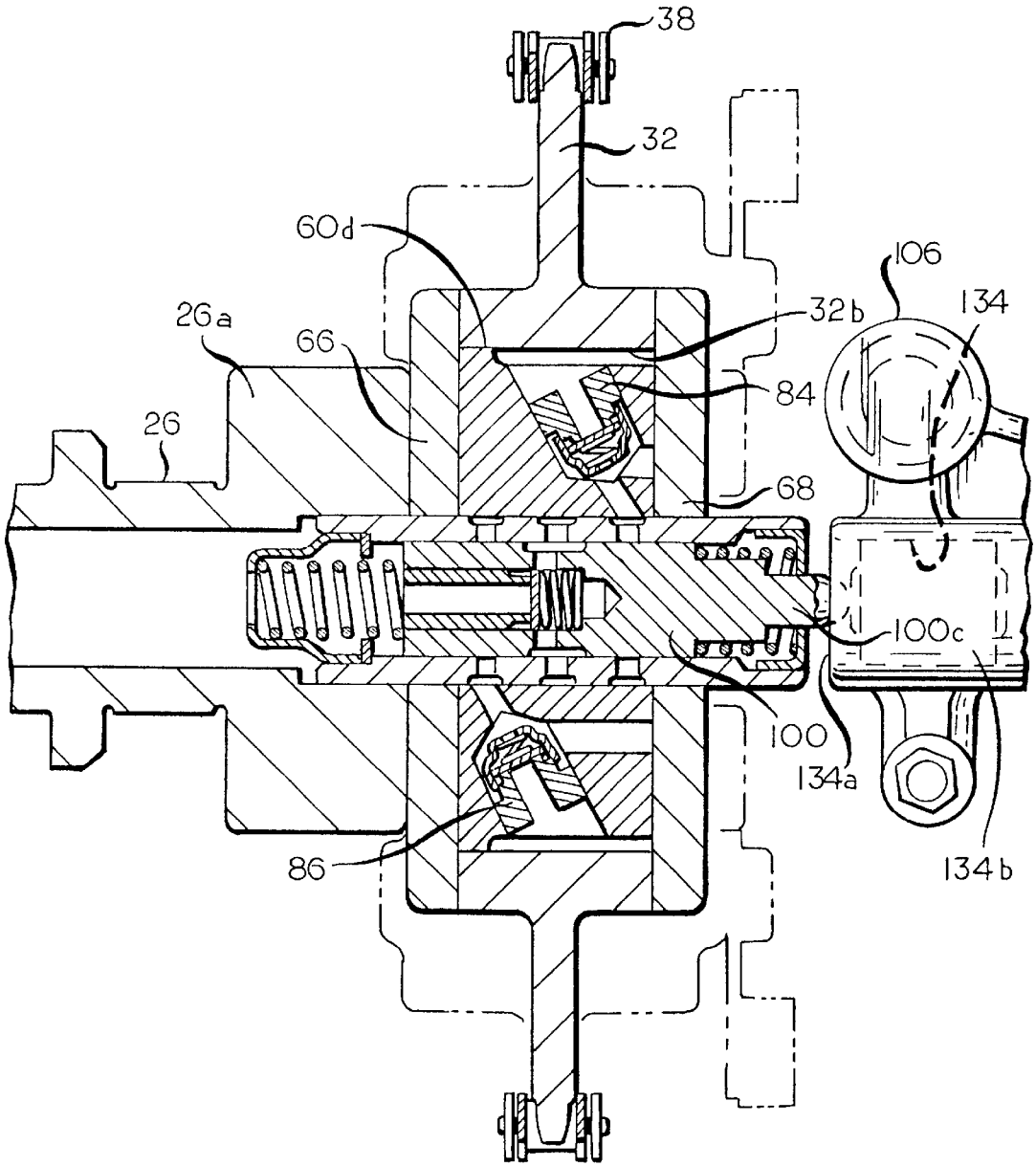
FIG. 4 (PRIOR ART)
FIG. 4 is a sectional view taken on line 4—4 of FIG. 2.
Figure 6:
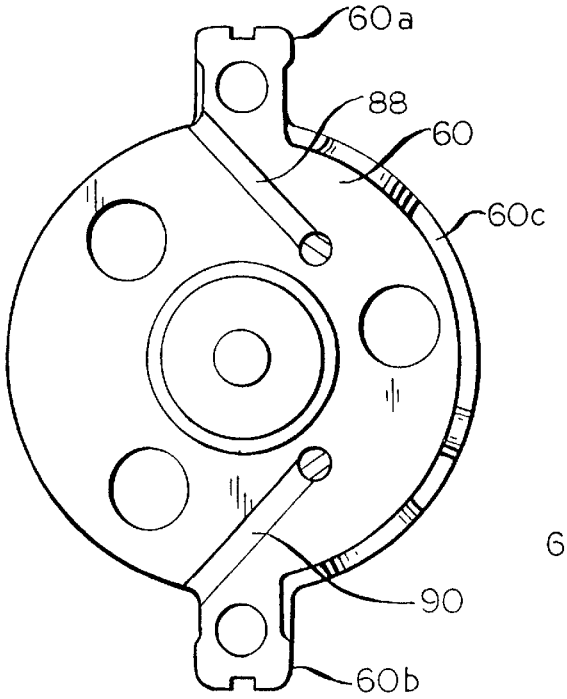
FIG. 6 (PRIOR ART)
FIG. 6 is an end elevational view of an element of the variable camshaft timing system of FIGS. 1–5.
Figure 7:
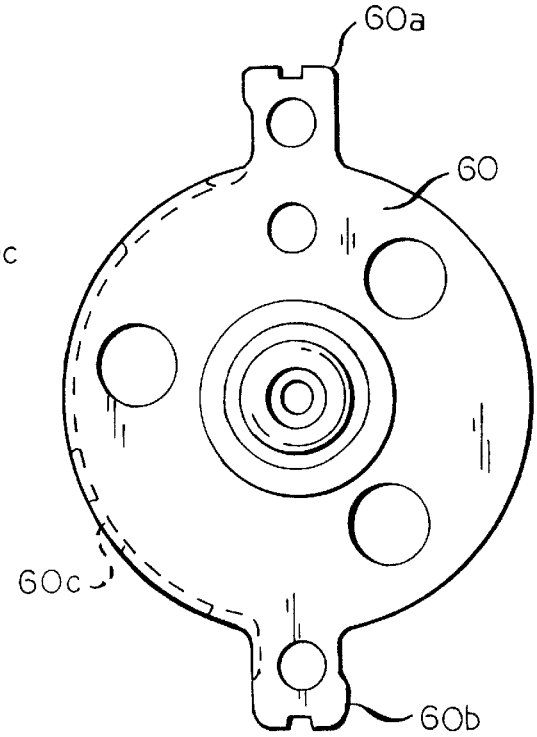
FIG. 7 (PRIOR ART)
FIG. 7 is an elevational view of the element of FIG. 6 from the opposite end thereof.
Figure 5:
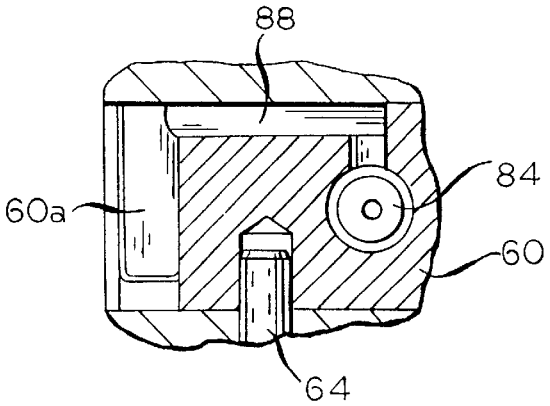
FIG. 5 (PRIOR ART)
FIG. 5 is a sectional view taken on line 5—5 of FIG. 2.
Figure 8:
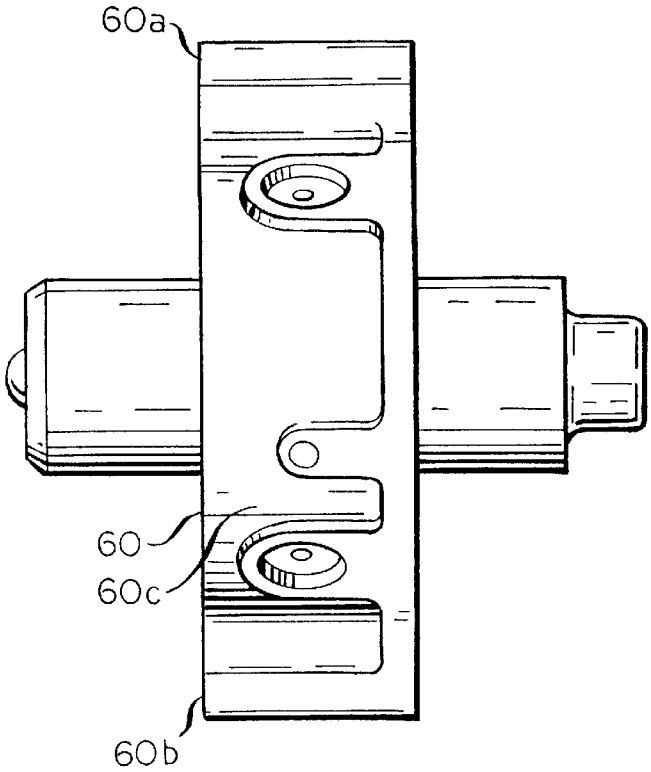
FIG. 8 (PRIOR ART)
FIG. 8 is a side elevational view of the element of FIGS. 6 and 7.
Figure 9:
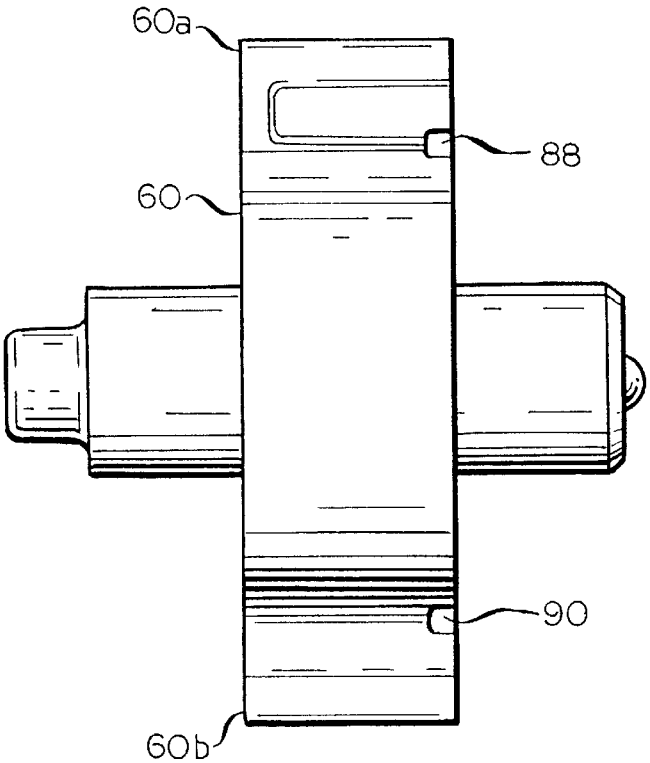
FIG. 9 (PRIOR ART)
FIG. 9 is an elevational view of the element of FIG. 8 from the opposite side thereof.

The pressure within the cylinder 134 is controlled by a solenoid 106, preferably of the pulse width modulated type, (PWM), in response to a control signal from an electronic engine control unit (ECU) 108, shown schematically, which may be of conventional construction. With the spool 108 in its null position when the pressure in the cylinder 134 is equal to one-half the pressure in the portion 198*a*, as heretofore described, the on-off pulses of the solenoid 106 will be of equal duration; by increasing or decreasing the on duration relative to the off duration, the pressure in the cylinder 134 will be increased or decreased relative to such one-half level, thereby moving the spool 100 to the right or to the left, respectively. The solenoid 106 receives engine oil from the engine oil gallery 130 through an inlet line 140 and selectively delivers engine oil from such source to the cylinder 134 through a supply line 138. As is shown in FIGS. 3 and 4, the cylinder 134 may be mounted at an exposed end of the camshaft 26 so that the piston 134*a* bears against an exposed free end 100*c* of the spool 100. In this case, the solenoid 106 is preferably mounted in a housing 134*b* that also houses the cylinder 134*a*.

Make-up oil for the recesses 32*a*, 32*b* of the sprocket 32 to compensate for leakage therefrom is provided by way of a small, internal passage 120 within the spool 100, from the passage 98*a* to an annular space 98*b* of the cylindrical member 98, from which it can flow into the inlet line 82. A check valve 122 is positioned within the passage 120 to block the flow of oil from the annular space 98*b* to the portion 98*a* of the cylindrical member 98.

The vane 60 is alternatingly urged in clockwise and counterclockwise directions by the torque pulsations in the camshaft 26 and these torque pulsations tend to oscillate the vane 60, and, thus, the camshaft 26, relative to the sprocket 32. However, in the FIG. 10 position of the spool 100 within the cylindrical member 98, such oscillation is prevented by the hydraulic fluid within the recesses 32*a*, 32*b* of the sprocket 32 on opposite sides of the lobes 60*a*, 60*b*, respectively, of the vane 60, because no hydraulic fluid can leave either of the recesses 32*a*, 32*b*, since both return lines 94, 96 are blocked by the position of the spool 100, in the FIG. 10 condition of the system. If, for example, it is desired to permit the camshaft 26 and the vane 60 to move in a counterclockwise direction with respect to the sprocket 32, it is only necessary to increase the pressure within the cylinder 34 to a level greater than one-half that in the portion 98*a* of the cylindrical member. This will urge the spool 100 to the right and thereby unblock the return line 94. In this condition of the apparatus, counterclockwise torque pulsations in the camshaft 26 will pump fluid out of a portion of the recess 32*a* and allow the lobe 62*a* of vane 60 to move into the portion of the recess which has been emptied of hydraulic fluid. However, reverse movement of the vane will not occur as the torque pulsations in the camshaft become oppositely directed unless and until the spool 100 moves to the left, because of the blockage of fluid flow through the return line 96 by the land 100*b* of the spool 100. While illustrated as a separate closed passage in FIG. 10, the periphery of the vane 60 has an open oil passage slot, element 60*c* in FIGS. 1, 2, 6, 7 and 8, which permits the transfer of oil between the portion of the recess 32*a* on the right side of the lobe 60*a* and the portion of the recess 32*b* on the right side of the lobe 60*b*, which are the non-active sides of the lobes 60*a*, 60*b*; thus, counterclockwise movement of the vane 60 relative to the sprocket 32 will occur when flow is permitted through return line 94 and clockwise movement will occur when flow is permitted through return line 96. Further, the passage 82 is provided with an extension 82*a* to the non-active side of one of the lobes 60*a*, 60*b*, shown as the lobe 60*b*, to permit a continuous supply of make-up oil to the non-active sides of the lobes 60*a*, 60*b* for better rotational balance, improved damping of vane motion, and improved lubrication of the bearing surfaces of the vane 60.

The elements of the structure of FIGS. 1–9 that correspond to the elements of FIG. 10, as described above, are identified in FIGS. 1–9 by the reference numerals that were used in FIG. 10, it is being noted that the check valves 84 and 86 are disc-type check valves in FIGS. 1–9 as opposed to the ball type check valves of FIG. 10. While disc-type check valves are preferred for the embodiment of FIGS. 1–9, it is to be understood that other types of check valves can also be used.

Figure 11:
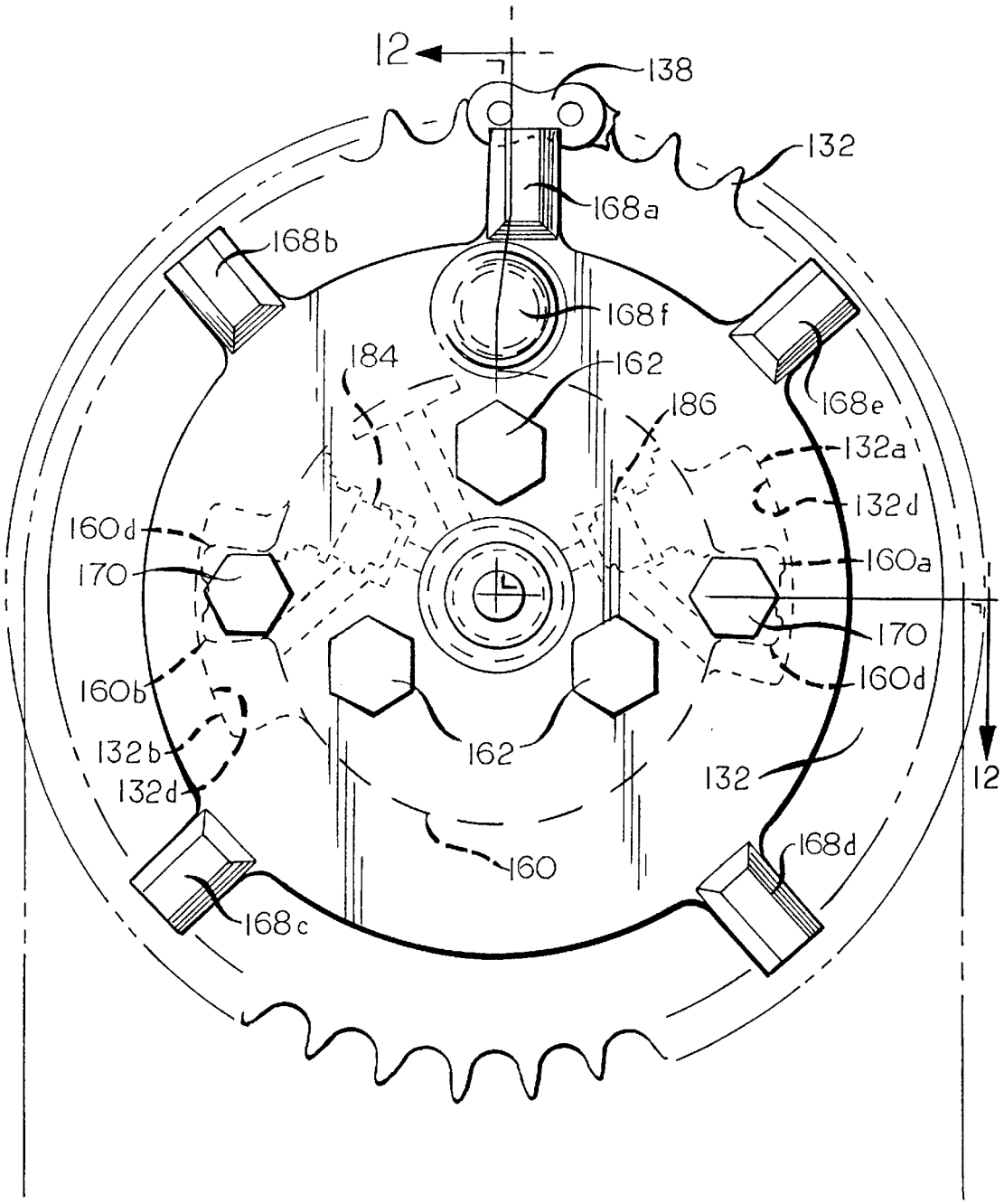
FIG. 11 is a view generally similar to FIG. 2 illustrating a variable camshaft timing system with a locking or latching feature according to the preferred embodiment of the present invention incorporated therein.
Figure 12:
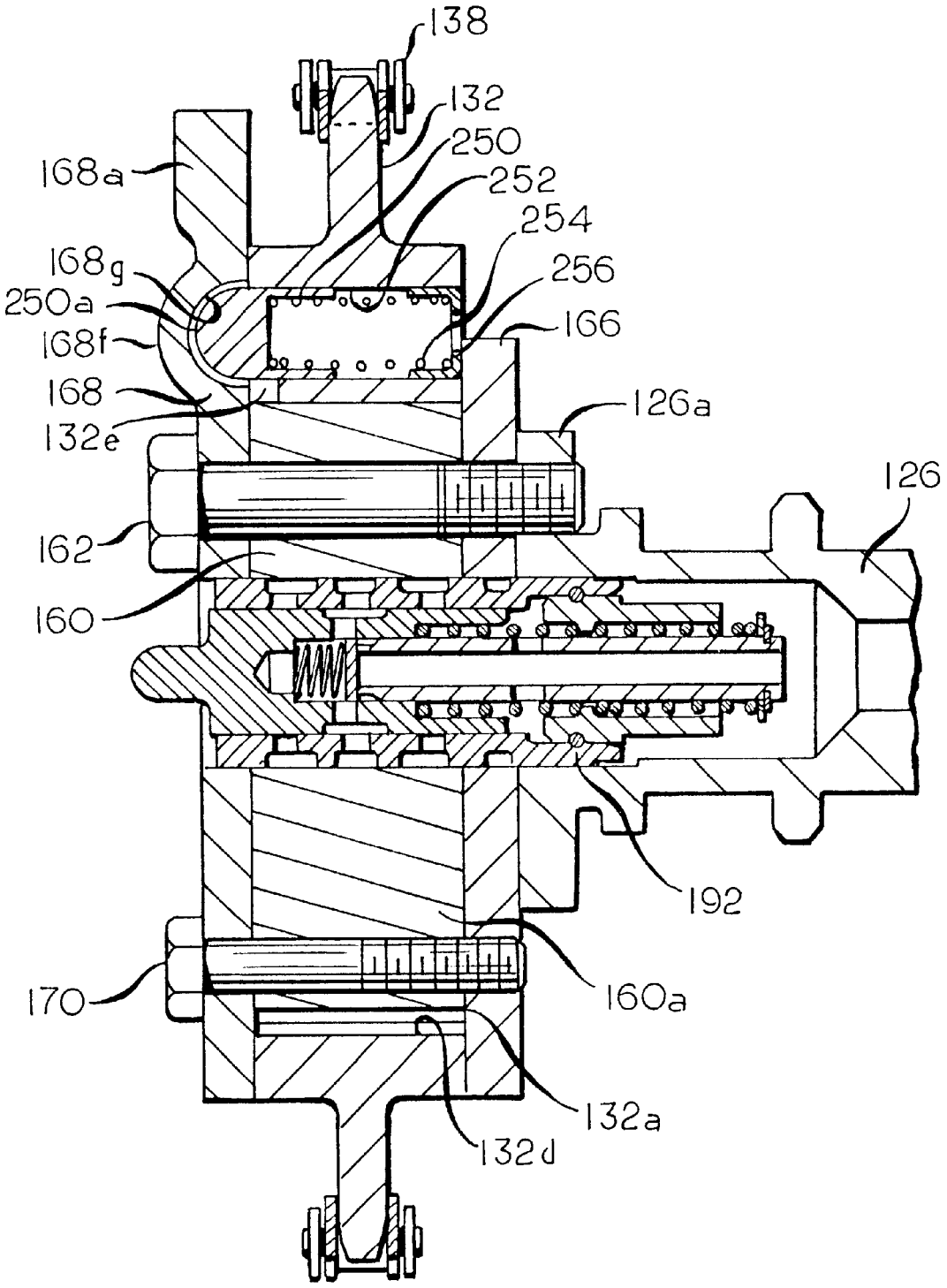
FIG. 12 is a sectional view taken on line 12—12 of FIG. 11.

In the embodiment of FIGS. 11 and 12, the various elements are identified by 3 digit reference numerals when an element of the embodiment of FIGS. 11 and 12 corresponds to an element of the embodiment of FIGS. 1–10; the last 2 digits of the element of the embodiment of FIGS. 11 and 12 are the reference numerals for the corresponding element of the embodiment of FIGS. 1–10 and the first digit is 1 digit higher than that of the corresponding element of the embodiment of FIGS. 1–10. Thus in the embodiment of FIGS. 11 and 12, there is provided a variable camshaft timing (VCT) system in which a housing in the form of a sprocket 132 is oscillatingly journalled on a camshaft 126. The camshaft 126 may be considered to be the only camshaft of a single camshaft engine, either of the overhead camshaft type or the in block camshaft type. Alternatively, the camshaft 126 may be considered to be either the intake valve operating camshaft or the exhaust valve operating camshaft of a dual camshaft engine. In any case, the sprocket 132 and the camshaft 126 are rotatable together, and are caused to rotate by the application of torque to the sprocket 132 by an endless roller chain 138, shown fragmentarily, which is trained around the sprocket 132 and also around a crankshaft, not shown. As will be hereinafter described in greater detail, the sprocket 132 is oscillatingly journalled on the camshaft 126 so that it is oscillatable at least through a limited arc with respect to the camshaft 126 during the rotation of the camshaft, an action that will adjust the phase of the camshaft 126 relative to the crankshaft.

An annular pumping vane 160 is fixedly positioned on the camshaft 126, the vane 160 having a diametrically opposed pair of radially outwardly projecting lobes 160*a*, 160*b* and being attached to an enlarged end portion 126*a* of the camshaft 126 by bolts 162 that pass through the vane 160 into the end portion 126*a*. The lobes 160*a*, 160*b* are received in radially outwardly projecting recesses 132*a*, 132*b*, respectively, of the sprocket 132, the circumferential extent of each of the recesses 132*a*, 132*b* being somewhat greater than the circumferential extent of the vane lobe 160*a*, 160*b* that is received in such recess to permit limited oscillating movement of the sprocket 132 relative to the vane 160. The recesses 132*a*, 132*b* are closed around the lobes 160*a*, 160*b*, respectively, by spaced apart, transversely extending annular plates 166, 168 that are fixed relative to the vane 160, and, thus, relative to the camshaft 126, by bolts 170 which extend from one to the other through the same lobe, 160*a* or 160*b*. Further, the inside diameter 132*c* of the sprocket 132 is sealed with respect to the outside diameter of the portion 160*d* of the vane 160 that is between the lobe 160*a*, 160*b*, and the tips of the lobes 160*a*, 160*b* of the vane 160 are provided with seal receiving slots 160*e*, 160*f*, respectively, which are adapted to sealingly engage the diametrical surface 132*d* within each of the recesses 132*a*, 132*b*. Thus, each of the recesses 132*a*, 132*b* of the sprocket 132 is capable of sustaining hydraulic pressure, and within each recess 132*a*, 132*b* the portion on each side of the lobe 160*a*, 160*b*, respectively, is capable of sustaining hydraulic pressure. The annular plate 168 is provided with a plurality of radial projections 168*a*–168*e* non evenly spaced around its exterior to permit a position sensor, not shown, to determine the circumferential position of the plate 168 and the vane 160 based on the spacing detected between an adjacent pair of such projections during a sensing step.

The VCT system of the embodiment of FIGS. 11 and 12 is provided with a spool valve 192 and check valves 184, 186, which correspond in structure and function to the spool valve 92 and the check valves 84, 86, respectively, of the embodiment of FIGS. 1–10.

During times of low hydraulic fluid pressure within the sprocket 132, for example, during and shortly after the restarting of the engine incorporating such VCT system in the case of a VCT system that is operated by pressurized engine lubricating oil, the vane 160 is positively latched to the sprocket 132 by a pin 250 that is slidable to and fro within a passage 252 in the sprocket 132, the passage 252 being spaced from and extending parallel to the longitudinal axis of rotation of the camshaft 126. The pin 250 has an outer or leading end 250*a* that is hemispherical in shape, and the opposed end of the pin 250 is acted on by a compression spring 254 that is trapped within the passage by a retainer 256 to bias the end 250*a* of the pin 250 outwardly from the passage 252. The advance of the pin 250 outwardly from the passage 252 is limited by the plate 168, which rotates with the vane 160, as heretofore described.

The plate 168 has an externally projecting bulge 168*f*, which defines an inwardly facing pocket 168*g* of hemispherical configuration, whose radius of curvature is somewhat greater than that of the end 250*a* of the pin 250. The pocket 168*g* is axially aligned with the passage 252 in a predetermined position of the vane 160 relative to the sprocket 132, preferably when each of the lobes 160*a*, 160*b* is positioned at the midpoint of its range of travel within its recess 132*a*, 132*b*, respectively. Thus, the spring 254 is free to drive the end 250*a* of the pin 250 into the pocket 168*g*of the plate 168 when the passage 252 and the pocket 168*g* are in alignment. However, the pocket 168*g* is in communication with the engine oil or other hydraulic fluid that is being used in the VCT system of this embodiment through a passage 132*e* in the sprocket 132, and when this hydraulic fluid is under pressure, as it will be during normal operation of the engine, hydraulic pressure within the pocket 168*g* will keep all portions of the pin 250 within the passage 252, to thereby permit oscillation of the vane 160 relative to the sprocket 132 as directed by an engine controller corresponding to the engine control unit 108 of the embodiment of FIGS. 1–10, or otherwise. In this way, the pin 250 will automatically function to latch or lock the position of the vane 160 relative to the sprocket 132 only during periods of low system hydraulic pressure when the vane 160 could otherwise behave erratically because of inadequate hydraulic pressure to ensure its proper operation. Such a condition could otherwise lead to undesired impacts between the lobes 160*a*, 160*b* of the vane 160 and the surfaces of the recesses 132*a*, 132*b*, respectively, of the sprocket 132 in which they are received, with excessive noise and impact damage possibly resulting therefrom.

Although the best mode contemplated by the inventor for carrying out the present invention as of the filing date hereof has been shown and described herein, it will be apparent to those skilled in the art that suitable modifications, variations, and equivalents may be made without departing from the scope of the invention, such scope being limited solely by the terms of the following claims and the legal equivalents thereof.

What is claimed is:

1. In an internal combustion engine having a crankshaft that is rotatable about an axis, a combination comprising:

a camshaft (126), said camshaft being rotatable about a second axis, said second axis being parallel to the axis, said camshaft being subject to torque reversals during the rotation thereof;

a vane (160) having at least one lobe (160*a*/160*b*), said vane being attached to said camshaft, being rotatable with said camshaft and being non-oscillatable with respect to said camshaft;

a housing (132), said housing being rotatable with said camshaft and being oscillatable with respect to said camshaft, said housing having at least one recess (132*a*/132*b*), said at least one recess receiving said at least one lobe, said at least one lobe being oscillatable within said at least one recess;

rotary movement transmitting means (138) for transmitting rotary movement from the crankshaft to the said housing;

wherein said housing comprises a passage (252) therein, a pin (250) slidably positioned within said passage, said pin having an inner end and an outer end (252*a*), and means (256) resiliently acting on said inner end of said pin to urge said outer end of said pin outwardly from said passage;

said vane having a plate (168) secured thereto, said plate being rotatable with said vane and being non-rotatable with respect thereto, said plate having an inwardly facing pocket (168*f*), said pocket being aligned with said passage in a predetermined position of said vane with respect to said housing and being adapted to receive said outer end of said pin in said predetermined position of said vane with respect to said housing to prevent oscillation of said housing with respect to said camshaft;

said pocket being adapted to receive pressurized hydraulic fluid, from a source (132*e*) that is not in series with said at least one recess, the hydraulic fluid, when under normal pressurization, overcoming the effect of said means acting resiliently on said inner end of said pin and maintaining said outer end of said pin out of said pocket to permit oscillation of said housing with respect to said camshaft.

2. An internal combustion engine according to claim 1 wherein said passage extends generally parallel to a longitudinal axis of rotation of said camshaft and is spaced therefrom.

3. An internal combustion engine according to claim 2 wherein said outer end of said pin is hemispherical in configuration, wherein said pocket has an inner surface that is hemispherical in configuration, and wherein said inner surface of said pocket has a radius of curvature that is at least slightly greater than a radius of curvature of said outer end of said pin.

4. An engine according to claim 3 wherein a first portion and a second portion of said at least one recess is capable of sustaining hydraulic pressure.

5. In an internal combustion engine having a crankshaft that is rotatable about an axis, a combination comprising:

a camshaft (126), said camshaft being rotatable about a second axis, said second axis being parallel to the axis, said camshaft being subject to torque reversals during the rotation thereof;

a vane (160) having first and second circumferentially spaced apart lobes (160*a*, 160*b*), said vane being attached to said camshaft, being rotatable with said camshaft and being non-oscillatable with respect to said camshaft;

a housing (132), said housing being rotatable with said camshaft and being oscillatable with respect to said camshaft, said housing having first and second circumferentially spaced apart recesses (132*a*, 132*b*), each of said first and second recesses receiving one of said first and second lobes and permitting oscillating movement of said one of said first and second lobes therein;

rotary movement transmitting means (138) for transmitting rotary movement from the crankshaft to the housing;

wherein said housing comprises a passage (252) therein, a pin (250) positioned within said passage, said pin having an inner end and an outer end (250*a*), and means (256) resiliently acting on said inner end of said pin to urge said outer end of said pin outwardly from said passage;

said vane having a plate (168) secured thereto, said plate being rotatable with said vane and being non-rotatable with respect thereto, said plate having an inwardly facing pocket (168*f*), said pocket being aligned with said passage in a predetermined position of said vane with respect to said housing and being adapted to receive said outer end of said pin in said predetermined position of said vane with respect to said housing to prevent oscillation of said housing with respect to said camshaft;

said pocket being adapted to receive pressurized hydraulic fluid from a source (132*e*) that is not in series with said at least one recess, the hydraulic fluid, when under normal pressurization, overcoming the effect of said means acting resiliently on said inner end of said pin and maintaining said outer end of said pin out of said pocket to permit oscillation of said housing with respect to said camshaft.

6. An internal combustion engine according to claim 5 wherein said passage extends generally parallel to a longitudinal axis of rotation of said camshaft and is spaced therefrom.

7. An internal combustion engine according to claim 6 wherein said outer end of said pin is hemispherical in configuration, wherein said pocket has an inner surface that is hemispherical in configuration and wherein said inner surface of said pocket has a radius of curvature that is at least slightly greater than a radius of curvature of said outer end of said pin.

8. An engine according to claim 7 wherein a first portion and a second portion of each of said first and second recesses is capable of sustaining hydraulic pressure.

* * * * *